US006916983B2

(12) United States Patent
Orsini et al.

(10) Patent No.: US 6,916,983 B2
(45) Date of Patent: Jul. 12, 2005

(54) GROUNDING ELECTRODE

(75) Inventors: Joseph Orsini, Cromwell, CT (US); Daniel Toce, South Windsor, CT (US)

(73) Assignee: Tocini Industries, LLC, South Windsor, CT (US)

( * ) Notice: Subject to any disclaimer, the term of this patent is extended or adjusted under 35 U.S.C. 154(b) by 0 days.

(21) Appl. No.: 10/120,616

(22) Filed: Apr. 11, 2002

(65) Prior Publication Data

US 2003/0192713 A1 Oct. 16, 2003

(51) Int. Cl.[7] ..... H01R 4/00

(52) U.S. Cl. ..... 174/7; 174/6; 174/2; 174/3; 361/117; 52/165

(58) Field of Search ..... 174/7, 6, 2, 3, 174/55 G; 361/117; 52/165

(56) References Cited

U.S. PATENT DOCUMENTS

| | | | | | |
|---|---|---|---|---|---|
| 3,566,000 | A | * | 2/1971 | Maurer et al. | 174/7 |
| 3,930,111 | A | * | 12/1975 | Sheelor | 174/6 |
| 4,156,793 | A | | 5/1979 | Carlson | 174/7 |
| 4,284,321 | A | | 8/1981 | Detemple et al. | 439/581 |
| 4,448,264 | A | | 5/1984 | Peyton | 173/52 |
| 4,551,633 | A | | 11/1985 | Winter et al. | 307/147 |
| 4,577,053 | A | | 3/1986 | Kies | 174/7 |
| 4,688,969 | A | | 8/1987 | Bruser et al. | 405/303 |
| 4,912,415 | A | * | 3/1990 | Sorensen | 324/347 |
| 5,010,710 | A | | 4/1991 | Gray et al. | 52/742 |
| 5,029,427 | A | | 7/1991 | Jewett | 52/749 |
| 5,131,856 | A | | 7/1992 | Auclair | 439/100 |
| 5,174,386 | A | | 12/1992 | Crover | 173/93 |
| 5,248,002 | A | | 9/1993 | Williams | 173/1 |
| 5,337,836 | A | | 8/1994 | Williams | 173/90 |
| 5,525,208 | A | | 6/1996 | Pritula et al. | 205/724 |
| 5,608,186 | A | | 3/1997 | Collins, Jr. et al. | 174/7 |
| 5,865,979 | A | | 2/1999 | Collins, Jr. et al. | 205/145 |
| 6,137,049 | A | * | 10/2000 | Hecock | 174/7 |
| 6,234,259 | B1 | * | 5/2001 | Kuckes et al. | 175/73 |
| 6,245,989 | B1 | | 6/2001 | Iossel et al. | 174/6 |

OTHER PUBLICATIONS

Workbench publication, Jul. 18, 2001 by John Bisset, 3 pages.*

Jul. 18, 2001 Article in Online Radio World Newspaper, Workbench—Take This Rod and Shove It! By John Bisset.

DeMark Ground Rod Drivers, Advertising Brochure, no date.

U.S. Appl. No. 10/038,470, filed Nov. 8, 2001, Kikinis.

* cited by examiner

*Primary Examiner*—Dean A. Reichard
*Assistant Examiner*—Jinhee Lee
(74) *Attorney, Agent, or Firm*—St. Onge Steward Johnston & Reens LLC

(57) ABSTRACT

A grounding electrode suited for installation in very hard or rocky soil is a long conductive metal rod having a drilling bit at one end and a head adapted to mate with a drilling tool, preferably a hammer drill. The grounding electrode, together with a suitable connecting wire and a clamping device clamping the wire to the grounding electrode form an electrical grounding system for a home or commercial structure.

20 Claims, 4 Drawing Sheets

GROUNDING ELECTRODE

FIELD OF THE INVENTION

The invention relates to a drilling-type grounding electrode that eases the installation of grounding electrodes in various soil conditions.

BACKGROUND OF THE INVENTION

Grounding electrodes (or ground rods) used in conjunction with a grounding electrode conductor, are used to bond various electrically conductive pieces of equipment to the same ground potential. This accomplishes two important functions: first, for personnel and equipment safety; second, for establishing a common ground reference point for the electrical system.

Various municipalities have differing requirements for grounding installations. Many, for instance, rely upon NFPA 70, otherwise known as the National Electrical Code, while still others rely upon local or city codes. In any case, the vast majority requires the use of a grounding electrode for various installations, such as grounding an electrical service to a building, grounding the lightening protection system on a building, tying together a grounding grid utilized by some special buildings, or grounding various pieces of electrically conductive equipment that are in close proximity to an electrical potential or are at risk of coming into contact with an electrical potential.

Grounding electrodes are long (approximately 8 to 10 feet), thin rods that are driven into the earth and are intended to be connected to the system to be grounded. Generally, they are made of steel and have an outer coating of copper. They also generally have a pointed end, which is inserted into the earth, and a flat end for hammering to drive the electrode into the earth.

The problem faced by installers is that the earth may be very hard or may contain rocks, which inhibits the insertion of the grounding electrode into the earth. In addition, in the winter months, the earth may be frozen, which will further prevent installation.

Another problem faced is that the grounding electrode is between eight to ten feet long, therefore, in order to insert it into the ground, the installer must climb up on a ladder and attempt to strike the small end of the grounding electrode with a sledge hammer while maintaining a precarious balance on the ladder.

Yet another problem faced by installers is the spreading of the flat end of the grounding electrode as it is hammered into place. This is a problem because the flat end will become wider as it is continually hammered, thereby inhibiting the installation of the attachment device, typically an "acorn nut," for clamping the grounding electrode conductor to the grounding electrode.

Still another problem associated with the installation of grounding electrodes is that due to the difficultly of installation, installers may not fully insert the grounding electrode into the earth. The remaining portion of the grounding electrode is then cut off so that the remaining end is flush with grade. Altering the grounding electrode in this manner is undesired and in some cases does not comply with state and local codes. Due to the fact that the grounding electrode is inserted into the earth, inspectors may have a difficult time trying to ascertain whether the full length of the grounding electrode was inserted into the ground or whether a portion was cut off.

There have been many attempts to overcome these problems, but none have effectively overcome them. For instance, U.S. Pat. No. 5,337,836 ("the '836 patent") to Williams and U.S. Pat. No. 5,248,002 ("the '002 patent") to Williams both describe a device for installing a grounding electrode. Both these devices consist of a pipe, open on one end and closed on the other, with weights attached to the closed end. The grounding electrode is hammered into place by the installer. Both the '836 and the '002 patents provide a device that will not flatten the head of the grounding electrode. However, as can be seen from the figures, installers will still need to exert a substantial force in order to hammer the grounding electrode through hard earth. In addition, these devices will be difficult to handle while balancing on a ladder due to the length of the grounding electrode.

Another attempt to overcome these problems is disclosed in U.S. Pat. No. 5,029,427 ("the '427 patent") to Jewett and U.S. Pat. No. 5,010,710 ("the '710 patent") to Grey et al. Both the '427 and the '10 patents disclose systems for installing grounding electrodes with a driving machine. The clamp is attached to the grounding electrode to receive the end of the hammering device. This will protect the end from flattening, however, this requires the purchase of the clamping device along with the electric or pneumatic hammering device, which may be very expensive. In addition, both the '427 and the '710 patents provide only for hammering action, and in very rocky or hard soil. This may not be enough to drive the grounding electrode into the earth.

Yet another attempt to overcome these problems is disclosed in U.S. Pat. No. 4,688,969 ("the '969 patent") to Bruser et al. Th 69 patent discloses the use of a hollow auger bit and a shaft where the grounding electrode is received in the hollow center of the tool. The auger bit is drilled into the ground carrying the grounding electrode with it. Once the correct depth is reached, the auger bit is reversed and withdrawn, while the grounding electrode is left in the earth. The major drawback for this device is that it requires the use of very large equipment, such as an auger drill mounted to back of a utility truck, to implement. This equipment may be very expensive and cumbersome. Further, it is not clear that all municipalities would accept this installation method because the hole that is drilled for the grounding electrode is larger than the electrode, thereby creating very loose soil around it or even creating an air gap between the electrode and the earth. This will substantially decrease the effectiveness of the grounding electrode and may be unacceptable to the local authorities.

SUMMARY OF THE INVENTION

Therefore, what is desired is a grounding electrode system that will ease installation while at the same time not damage the end of the grounding electrode.

A system is further desired that will be very cost effective, small, lightweight and easy to use.

A system is also desired that will not compromise the effectiveness of the grounding electrode to provide a secure electrical ground of an electrical system to earth.

It is also desired to provide a grounding electrode that will readily indicate whether the factory end has been cut.

In accordance with one advantageous embodiment, a grounding system for grounding electrical potentials of an object to be grounded is provided comprising: an electrically conductive grounding electrode, having first and second ends, including: a head provided at the first end; and a drilling bit provided at the second end; a grounding electrode conductor having first and second ends, the first end being electrically connected to the object to be grounded; and an attachment device electrically connecting the second end of the grounding electrode conductor to the grounding electrode.

In accordance with another advantageous embodiment, a grounding electrode is provided comprising: an elongated electrically conducting metal shaft member having first and second ends; a head sized and adapted to be engaged by a drilling tool; and a drill bit provided at the second end.

In accordance with still another advantageous embodiment, a method for installing a grounding electrode in the earth is provided comprising the steps of: providing a grounding electrode having an elongated electrically conductive shaft member having first and second ends, with said first end having a head adapted to be engaged by a drilling tool, and said second end having a drill bit; engaging said head with said drilling tool; and actuating the drilling tool to drill the grounding electrode into the earth.

In accordance with yet another advantageous embodiment, a method of electrically grounding an object to be grounded is provided comprising the steps of: providing a grounding electrode having an elongated electrically conductive shaft member having first and second ends, with said first end having a head adapted to be engaged by a drilling tool, and said second end having a drill bit; engaging said head with said drilling tool; actuating the drilling tool to drill the grounding electrode into the earth; affixing a first end of a grounding electrode conductor to the grounding electrode to provide an electrical connection between the grounding electrode and the grounding electrode conductor; and affixing a second end of said grounding electrode conductor to the object to be grounded to provide an electrical connection between the grounding electrode conductor and the object to be grounded.

In accordance with still another advantageous embodiment, a grounding electrode is provided comprising: an elongated electrically conducting metal shaft member having first and second ends; and a factory end indicator, for visually indicating whether the factory length of the grounding electrode has been altered.

The invention and its particular features and advantages will become more apparent from the following detailed description considered with reference to the accompanying drawings.

DETAILED DESCRIPTION OF THE DRAWINGS

Figures 1, 2:
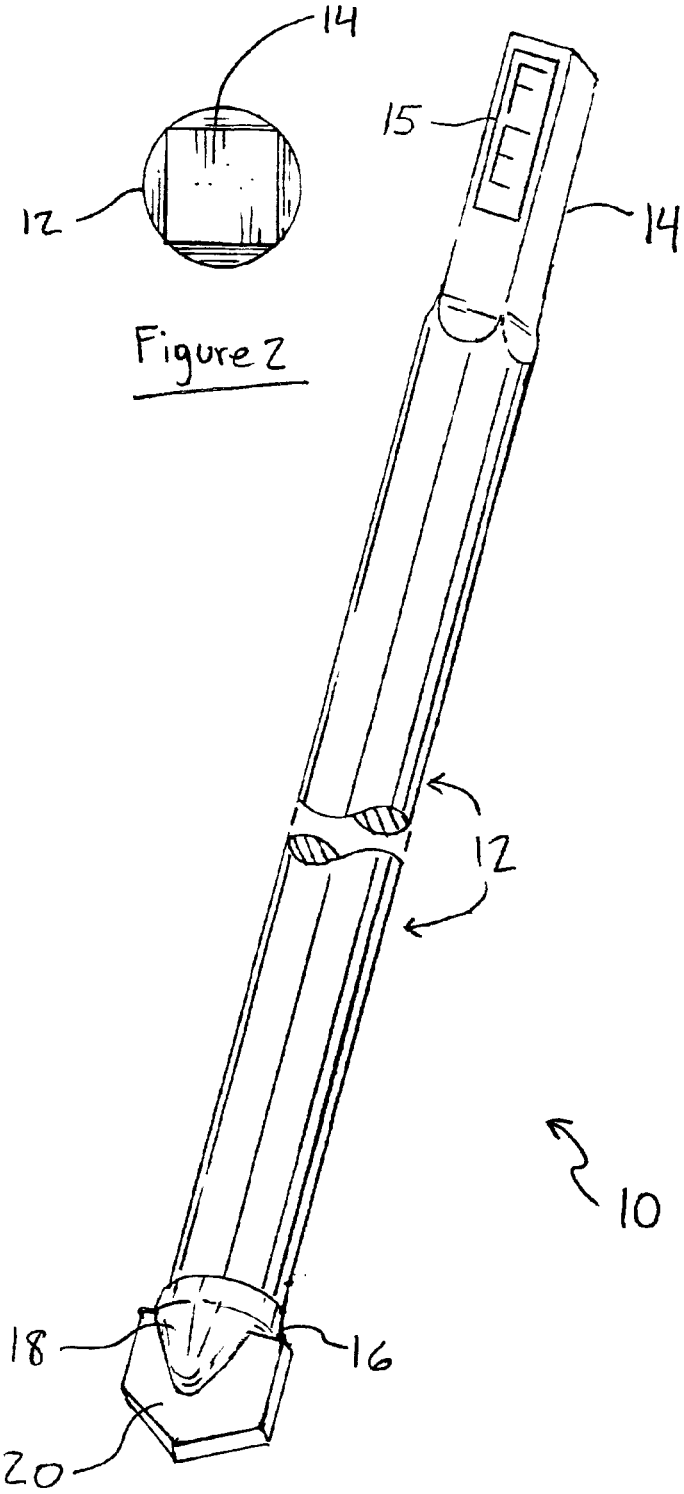
FIG. 1 is a depiction of a grounding electrode with a drill bit at one end and a head adapted for engagement by a socket at the other end.
FIG. 2 is a bottom view of the grounding electrode head adapted to receive a socket tool.

FIG. 1 illustrates the grounding electrode 10. The grounding electrode 10 comprises an elongated cylindrical body portion 12, a head 14, having a "Factory End" indicator 15, the head 14 being adapted to be received by an installation tool, and a bit end 16, adapted to facilitate insertion of the grounding electrode 10 in the ground.

The bit end 16 preferably comprises a masonry bit a shown having a conical section 18 with a blade 20 extending there through as shown in FIG. 1. The blade 20, preferably extends to approximately the diameter of the body portion 12, but may be wider than or narrower than the body portion 12. The blade 12 may be attached to the conical section 18 by any expedient means, such as, but not limited to; welding, bolting or friction fitting. In other embodiments, the bit end may have other drill type bit ends as are known in the art.

The grounding electrode 10 preferably is manufactured of a sturdy material such as steel to facilitate installation without deformation. In addition, the grounding electrode 10 is coated with a layer of copper along the body portion 12, to increase the electrical conductivity of the grounding electrode 10. Further, the conical section 18 and blade 20 are preferably manufactured of a sturdy material such as steel to facilitate installation of the grounding electrode 10.

The head 14 is adapted to receive an installation tool. The head 14 is shown as rectangular in form but may be keyed to any form that may be readily adapted to an installation tool. In addition, the "Factory End" indicator 15 is illustrated as a stamp or a sturdy mark in the metal comprising the head 14. However, the "Factory End" indicator 15 may comprise any visual indicator that would readily facilitate identification of an altered end such as but not limited to: a formed shape such as the square head 14, a stamp or symbol embedded in the metal, or a visible coating applied to the end. Further, the "Factory End" indicator 15 is shown on the head 14, however it may be located for instance, near the top of the body portion 12 or anywhere along the grounding electrode 10 that would provide a ready visual indication that it was the factory end.

FIG. 2 is a bottom view of the head 14. Again, the head 14 is depicted as rectangular in form but may be keyed to any form, for example, hexagonal, star head, Torx style head, slotted, etc., for adaptation to an installation tool. The dimensions of the head 14 may be sized to mate with any of a variety of standard sizes of commercially available socket tools.

Figure 3:
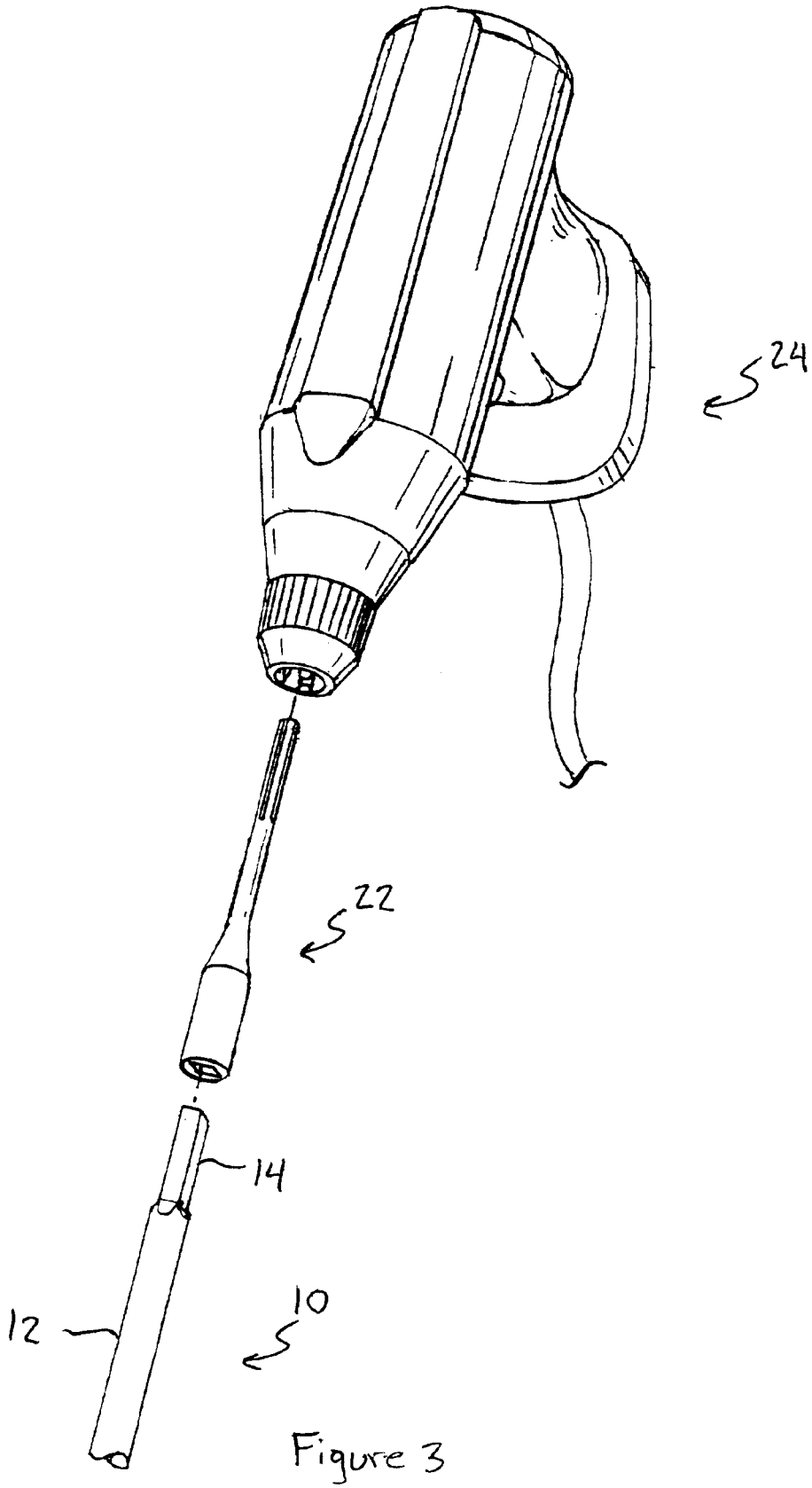
FIG. 3 is a perspective view illustrating how the grounding electrode is connected to a socket tool and a hammer drill.

FIG. 3 is a perspective view illustrating how the grounding electrode 10 is connected to, in this instance, a driver bit 22 and a hammer drill 24. The socket tool 22 and the hammer drill 24 may be any of a variety of readily available commercial products of standard sizes. The head 14 of the grounding electrode 10 is keyed to mate with the socket tool 22.

Figure 4:
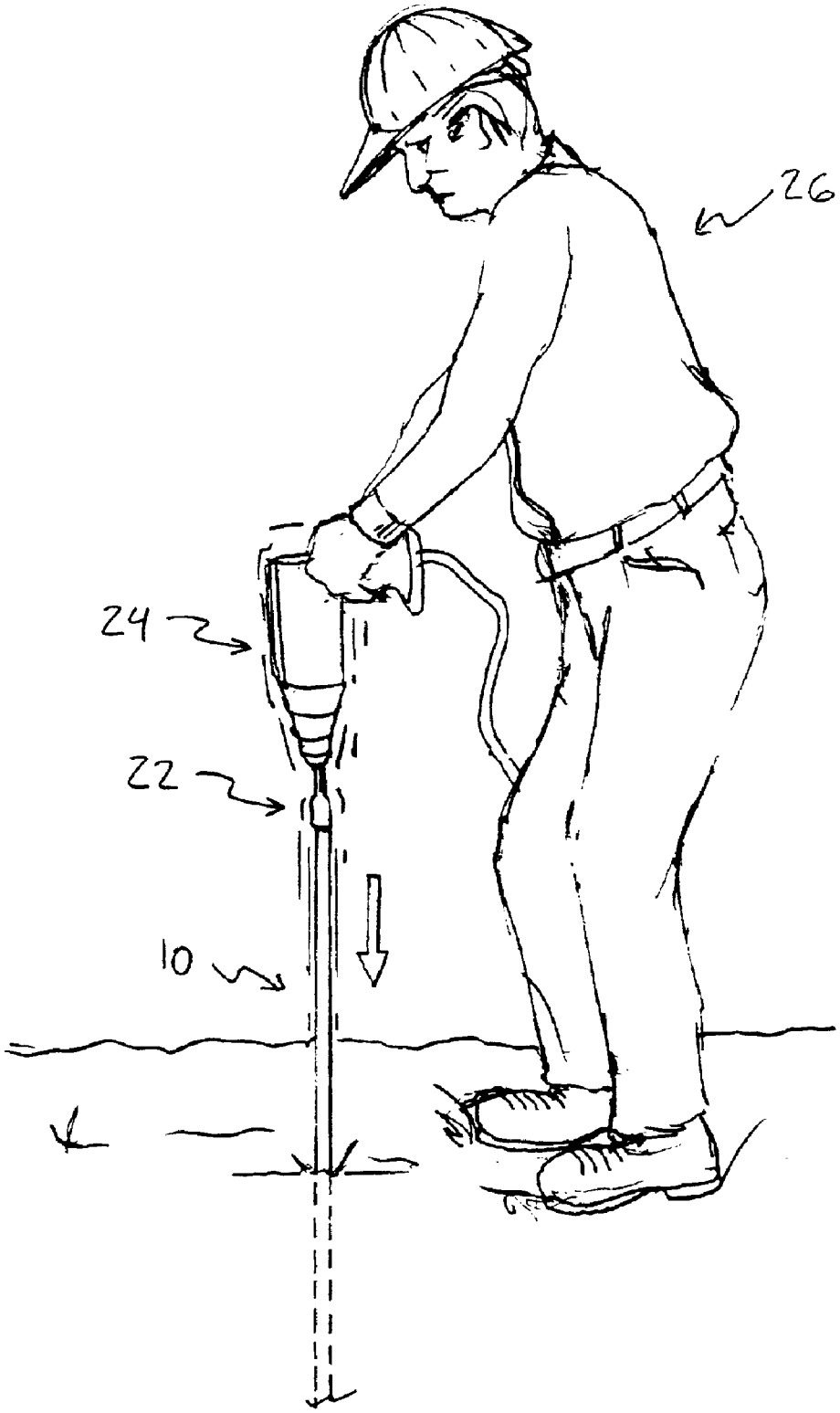
FIG. 4 is a perspective view illustrating the installation of the grounding electrode in the earth.

FIG. 4 is a perspective view illustrating the installation of the grounding electrode 10 in the earth. Conventional grounding electrodes have utilized various installation methods involving hammering a grounding electrode into the ground. However, with the utilization of a hammer drill 24 along with a socket tool 22, the installation of the grounding electrode 10 is much easier to effect because of the drilling action. Especially in areas where large quantities of rock and stone reside in the soil, the drilling along with the hammering action will facilitate the installation of the grounding electrode 10. In addition, because of the specific design of the grounding electrode 10, a user 26 may utilize inexpensive, portable, lightweight machinery and parts to facilitate installation. After the user 26 has inserted the grounding electrode 10 to the desired depth, it is a simple matter to disconnect the socket tool 22 and the hammer drill 24 from the grounding electrode 10.

Figure 5:
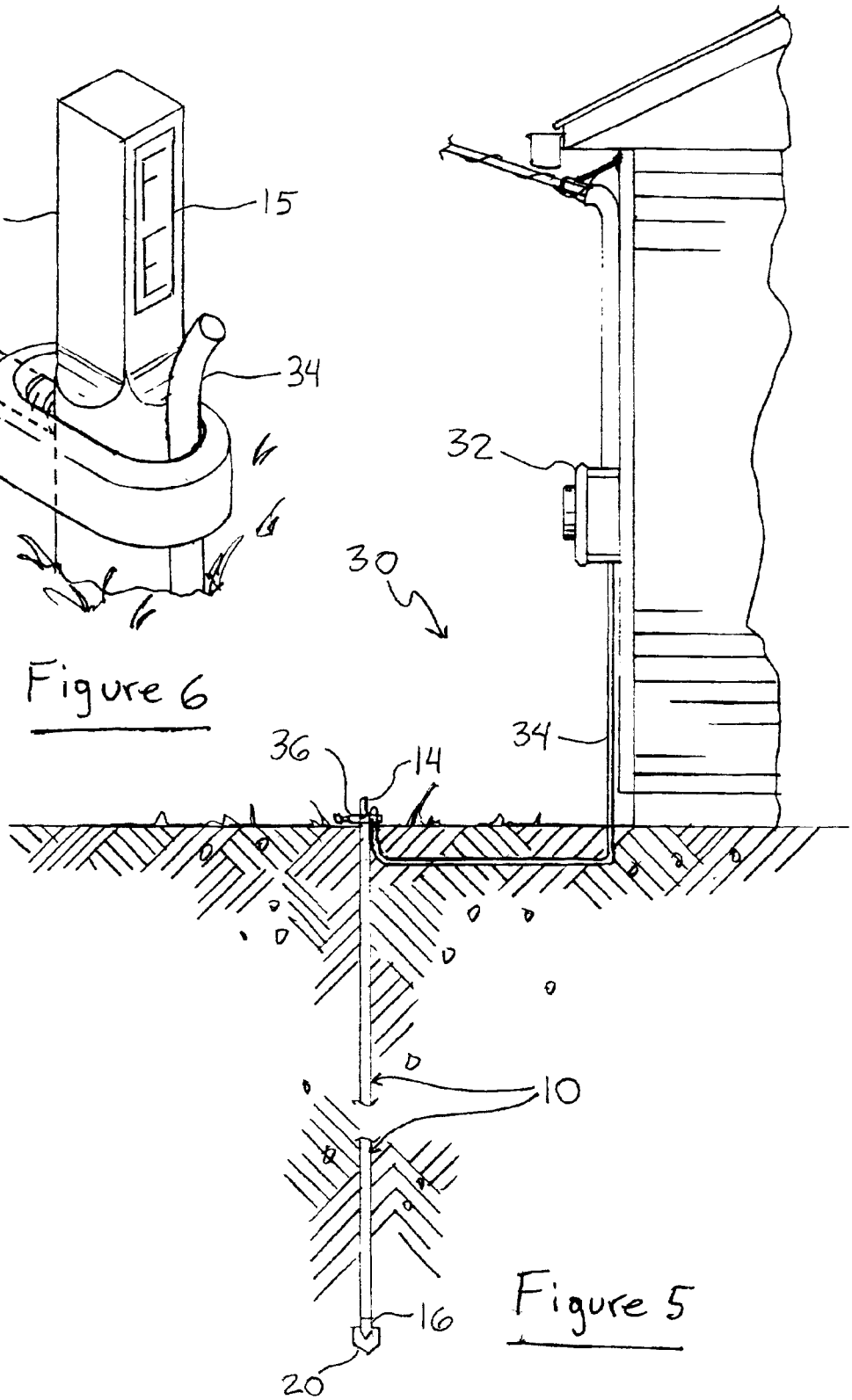
FIG. 5 is a perspective view in partial cross-section showing the grounding system with an installed ground rod with the accompanying grounding electrode conductor attached thereto.

FIG. 5 illustrates a grounding electrode system 30. The grounding electrode 10 has been installed in the ground for connection to, in this instance, an electric utility meter 32 for an electric service. A grounding electrode conductor 34 is connected at one end to the electric utility meter 32 and the electric service, and at the other end to the head 14 of the grounding electrode 10. The grounding electrode conductor 34 is in turn connected to the head 14 of the grounding electrode 10 by means of attachment device 36. Attachment device 36 comprises a clamping device as is well known in the art, typically called an "acorn nut" which operates by means of mechanical torsion being applied to the bolt, thereby clamping the grounding electrode conductor 34 between the attachment device 36 and the head 14 of the grounding electrode 10. The attachment device 36 and the grounding electrode conductor 34 are preferably manufactured of copper.

Figure 6:
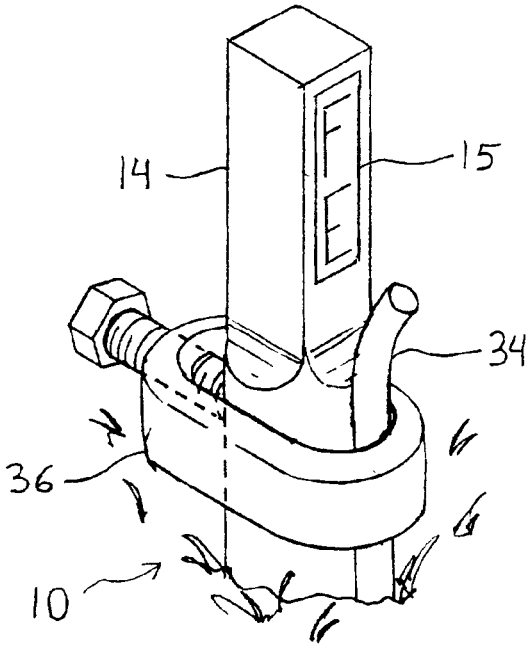
FIG. 6 is a perspective view showing the installed ground rod with the accompanying grounding electrode conductor attached thereto by means of the attachment device.

FIG. 6 is an enlarged depiction of the attachment device 36, connecting the grounding electrode conductor 34 to the head 14 of the grounding electrode 10. The head 14 of the grounding electrode 10 is shown slightly raised above the ground; however, the grounding electrode 10 may be installed so that the head is at or below grade level. In addition, the "Factory End" indicator 15 is shown so that it can readily be identified by visual inspection that the factory end of the grounding electrode 10 has not been cut.

Although the invention has been described with reference to a particular arrangement of parts, features and the like, these are not intended to exhaust all possible arrangements or features, and indeed many other modification and variation will be ascertainable to those of skill in the art.

What is claimed is:

1. A grounding system for grounding electrical potentials of an object to be grounded comprising:

an electrically conductive grounding electrode, having first and second ends, including:

a head provided at the first end; and a rotational drilling bit provided at the second end;

said head of said grounding electrode being non-circularly shaped to be fittingly engaged by a socket tool of a handheld power tool providing rotational force to said grounding electrode;

a grounding electrode conductor having first and second ends, the first end being electrically connected to the object to be grounded; and an attachment device electrically connecting the second end of the grounding electrode conductor to the grounding electrode.

2. The grounding system according to claim 1 wherein said drilling bit comprises a masonry bit.

3. The grounding system according to claim 1 wherein said head is sized to be engaged by a socket tool.

4. The grounding system according to claim 1 wherein said head is adapted to be engaged by a hammer drill.

5. The grounding system according to claim 1 wherein the attachment device comprises an acorn nut mounted to the grounding electrode.

6. The grounding system according to claim 1 wherein the grounding electrode conductor comprises copper wire.

7. The grounding system according to claim 1 wherein the grounding electrode is formed of steel and has a copper coating.

8. The grounding system according to claim 1 wherein the grounding electrode is at least eight feet long.

9. A grounding electrode comprising:

an elongated electrically conducting metal shaft member having first and second ends;

a head sized provided at the first end, sized and non-circularly shaped to be fittingly engaged by a socket tool of handheld power drilling tool for providing rotational force to said metal shaft member; and a rotational drill bit provided at the second end.

10. The grounding electrode according to claim 9 wherein said drill bit is a masonry bit.

11. The grounding electrode according to claim 10 wherein said head is sized and adapted to be engaged by a hammer drill.

12. The grounding electrode according to claim 11 wherein said head is sized and adapted to be engaged by a socket tool.

13. The grounding electrode according to claim 10 wherein the grounding electrode is formed of steel and has a copper coating.

14. The grounding electrode according to claim 13 wherein the grounding electrode is at least eight feet long.

15. The grounding electrode according to claim 13 wherein the grounding electrode is at least ten feet long.

16. The grounding electrode according to claim 13 further comprising a clamping device clamping a grounding electrode conductor to the grounding electrode.

17. A method for installing a grounding electrode in the earth comprising the steps of:

providing a grounding electrode having an elongated electrically conductive shaft member having first and second ends, with said first end having a head non-circularly shaped to be fittingly engaged by a socket tool of a handheld power rotary drilling tool, and said second end having a rotational drill bit;

engaging said head with said handheld power rotary drilling tool; and actuating the handheld power rotary drilling tool to rotationally drill the grounding electrode into the earth.

18. The method in accordance with claim 17 wherein said handheld power rotary drilling tool comprises a hammer drill operable to simultaneously drill and hammer said grounding electrode into the earth.

19. A method of electrically grounding an object to be grounded comprising the steps of:

providing a grounding electrode having an elongated electrically conductive shaft member having first and second ends, with said first end having a head non-circularly shaped to be fittingly engaged by a socket tool of a handheld power rotary drilling tool, and said second end a rotational drill bit;

engaging said head with said handheld power rotary drilling tool;

actuating the handheld power rotary drilling tool to rotationally drill the grounding electrode into the earth;

affixing a first end of a grounding electrode conductor to the grounding electrode to provide an electrical connection between the grounding electrode and the grounding electrode conductor; and affixing a second end of said grounding electrode conductor to the object to be grounded to provide an electrical connection between the grounding electrode conductor and the object to be grounded.

20. The method in accordance to claim 19 wherein said handheld power rotary drilling tool comprises a hammer drill operable to simultaneously drill and hammer said grounding electrode into the earth.

* * * * *